US005588897A

United States Patent [19]

Valentino

[11] Patent Number: 5,588,897

[45] **Date of Patent: *Dec. 31, 1996**

[54] BALLOON WITH CONNECTED PINWHEEL

[76] Inventor: George Valentino, 2667 Rockaway Ave., Oceanside, N.Y. 11572

[ * ] Notice: The term of this patent shall not extend beyond the expiration date of Pat. No. 5,395,276.

[21] Appl. No.: 400,981

[22] Filed: Mar. 7, 1995

Related U.S. Application Data

[63] Continuation of Ser. No. 86,336, Jul. 1, 1993, Pat. No. 5,395,276.

[51] Int. Cl.[6] ..... A63H 33/40

[52] U.S. Cl. ..... 446/217; 446/220; 446/222; 446/225

[58] Field of Search ..... 446/34, 220, 221, 446/222, 223, 225, 230, 232, 217, 218

[56] References Cited

U.S. PATENT DOCUMENTS

| | | | |
|---|---|---|---|
| 1,020,775 | 3/1912 | Ogden | 446/225 |
| 1,288,946 | 12/1918 | Lustig | 446/225 |
| 1,392,861 | 10/1921 | Tabacco | 446/217 |
| 1,543,954 | 6/1925 | Shira | 446/222 |
| 1,994,202 | 3/1935 | Sarsfield | 446/218 |
| 2,783,584 | 3/1957 | Venturella | 446/225 |
| 3,267,604 | 8/1966 | Goldsmith | 446/222 |
| 3,457,669 | 7/1969 | Green | 446/220 |
| 4,030,237 | 6/1977 | Lewis | 446/220 |
| 4,428,149 | 1/1984 | Brown | 446/222 |
| 4,661,081 | 4/1987 | Basseches | 446/220 |
| 4,798,554 | 1/1989 | Nelson et al. | 446/220 |
| 4,881,916 | 11/1989 | Houser | 446/220 |
| 4,895,545 | 1/1990 | Nelson | 446/220 |
| 5,295,891 | 3/1994 | Schalk | 446/222 |

FOREIGN PATENT DOCUMENTS

| | | | |
|---|---|---|---|
| 433269 | 12/1911 | France | 446/225 |
| 1427396 | 2/1923 | France | 446/225 |
| 729973 | 8/1932 | France | 446/225 |

*Primary Examiner*—Robert A. Hafer
*Assistant Examiner*—Jeffrey D. Carlson
*Attorney, Agent, or Firm*—Grimes & Battersby

[57] ABSTRACT

An aerial toy includes a balloon that can be filled with a lighter-than-air gas. It has a pinwheel connected to the lower portion of the balloon, preferably by use of the elastic filling stem of the lower portion of the balloon. A kite string is secured to the upper portion of the balloon for tilting the aerial toy forwardly when aloft. Preferably, the toy balloon has an oblong cross section, and when tilted forwardly, the oblong cross section serves to provide aerodynamic lift.

12 Claims, 3 Drawing Sheets

BALLOON WITH CONNECTED PINWHEEL

This application is a continuation of application Ser. No. 08/086,336 filed Jul. 1, 1993 and now U.S. Pat. No. 5,395, 276.

FIELD OF THE INVENTION

The present invention relates to an aerial toy formed by the combination of a balloon capable of receiving a lighter-than-air gas and a pinwheel, as well as an adaptor for connecting the pinwheel to the balloon.

BACKGROUND OF THE INVENTION

Balloons filled with a lighter-than-air gas have been popular toys for children, but the use of such balloons to provide a kite has been difficult in view of the instability of such balloons when sent aloft attached to a kite string. It is, therefore, an important feature of the present invention to provide an aerial toy which can function in the manner of a kite by using a balloon filled with a lighter-than-air gas, and yet has aerodynamic stability enhancing the enjoyment of the toy. A further object of the present invention is to provide an adaptor which can be connected readily to existing balloons in order to convert them into an aerial toy of the present invention.

SUMMARY OF THE INVENTION

According to the present invention, an aerial toy comprises a balloon adapted to be filled with a lighter-than-air gas. The balloon has an upper portion and a lower portion, and a pinwheel having a base portion is connected to the lower portion of the balloon. A kite string is secured to the upper portion of the balloon, and, in this way, subsequent filling of the balloon with a lighter-than-air gas enables the aerial toy to rise upwardly when the kite string is let out. Because the pinwheel is located below the balloon, upon tugging the kite string, the toy will tilt forwardly to provide aerodynamic stability.

The adapter is able to receive the filling stem from the lower portion of the balloon, and the adapter has a first portion with a flared opening for receiving the lower portion of the balloon and a hollow cylindrical second portion extending to an open end. An opening in the first portion of the adaptor receives the stem of the balloon, and a first slot extends from this opening along the cylindrical second portion to a second open end to enable the stem of the balloon to be pulled along the slot into the interior of the cylindrical second portion. A second slot extends along the cylindrical portion from the first slot and the second slot can receive the end portion of the filling stem. A cap member can then be fixed to the pinwheel and fitted over the open end to hold the stem in position within the second slot.

BRIEF DESCRIPTION OF THE DRAWINGS

These and other objects, advantages, and features of the present invention will become more apparent upon review of the descriptions below of illustrated embodiments of the invention, said descriptions being made in connection with the following drawing figures, wherein.

DESCRIPTION OF PREFERRED EMBODIMENTS

Figure 1:
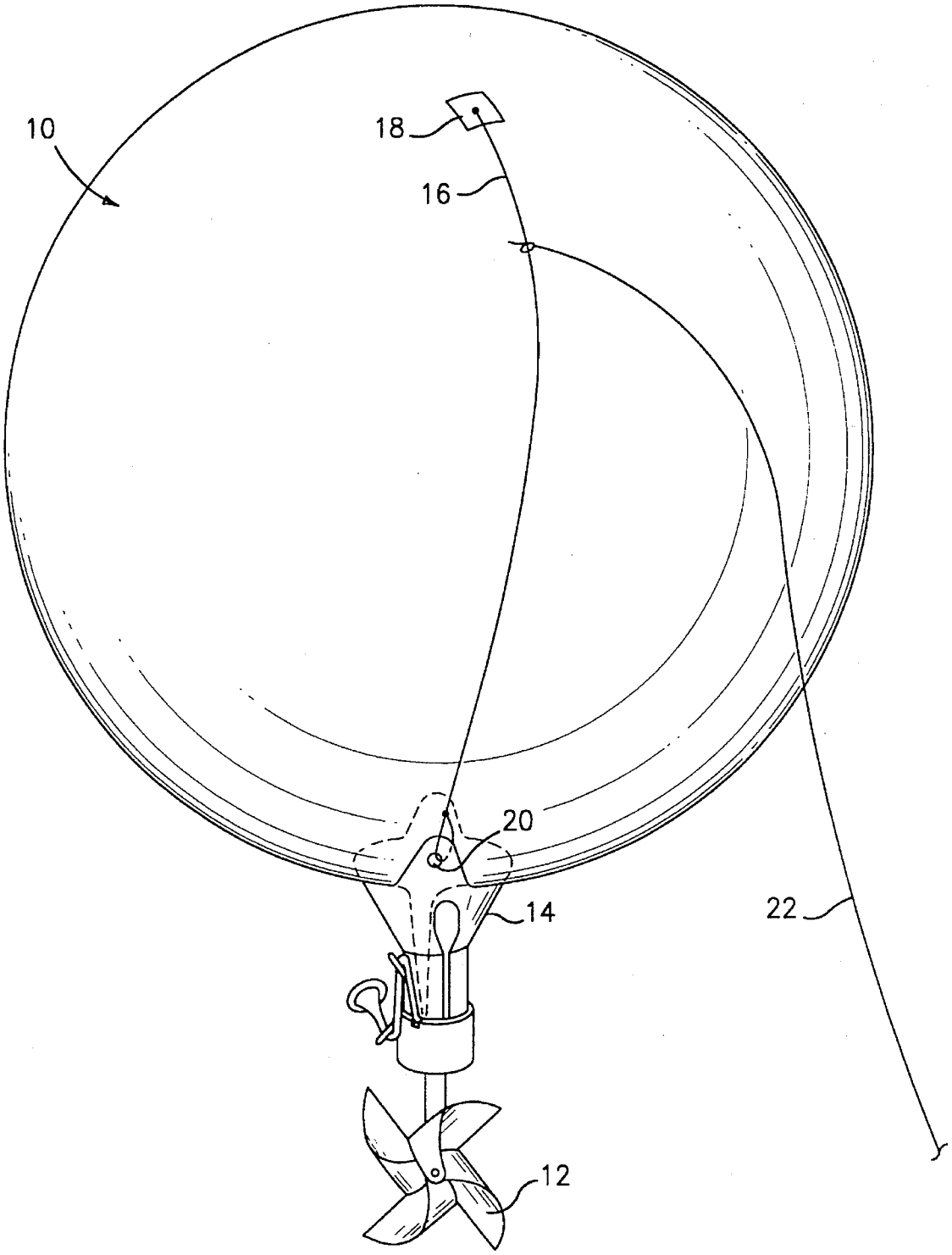
FIG. 1 is a perspective view of an aerial toy according to the present invention.

As illustrated in FIG. 1, a balloon 10 of the type adapted to be filled with a lighter-than-air gas such as helium has a pinwheel element 12 connected by an adaptor 14 of the present invention to a lower portion of the balloon 10. A string 16 is connected at 18 by an adhesive attachment to an upper portion of the balloon, and string 16 is connected at 20 to the adaptor 14. A string 22 preferably formed of a light weight high tensile strength line is connected to an upper portion of the string 16 to serve as a kite string and, in this way, the aerial toy of the present invention can be set aloft by letting out the kite string 22.

The helium-filled balloon 10 maintains the aerial toy of the present invention aloft, and the depending pinwheel 12 serves in the manner of the tail of a conventional kite to help stabilize the aerial toy. Additionally, wind flowing past the pinwheel 12 provides further positional stability to the aerial toy.

It has, additionally, been found that by tugging on the kite string 22 with the aerial toy aloft, the balloon will tilt forwardly. When the balloon of the well known Mylar type which has an oblong cross section, is used, the forward lilting of the balloon with the rotation of the pinwheel 12 tends to provide aerodynamic lift to the structure helping to further increase the dimensional stability of the aerial toy.

Figure 2:
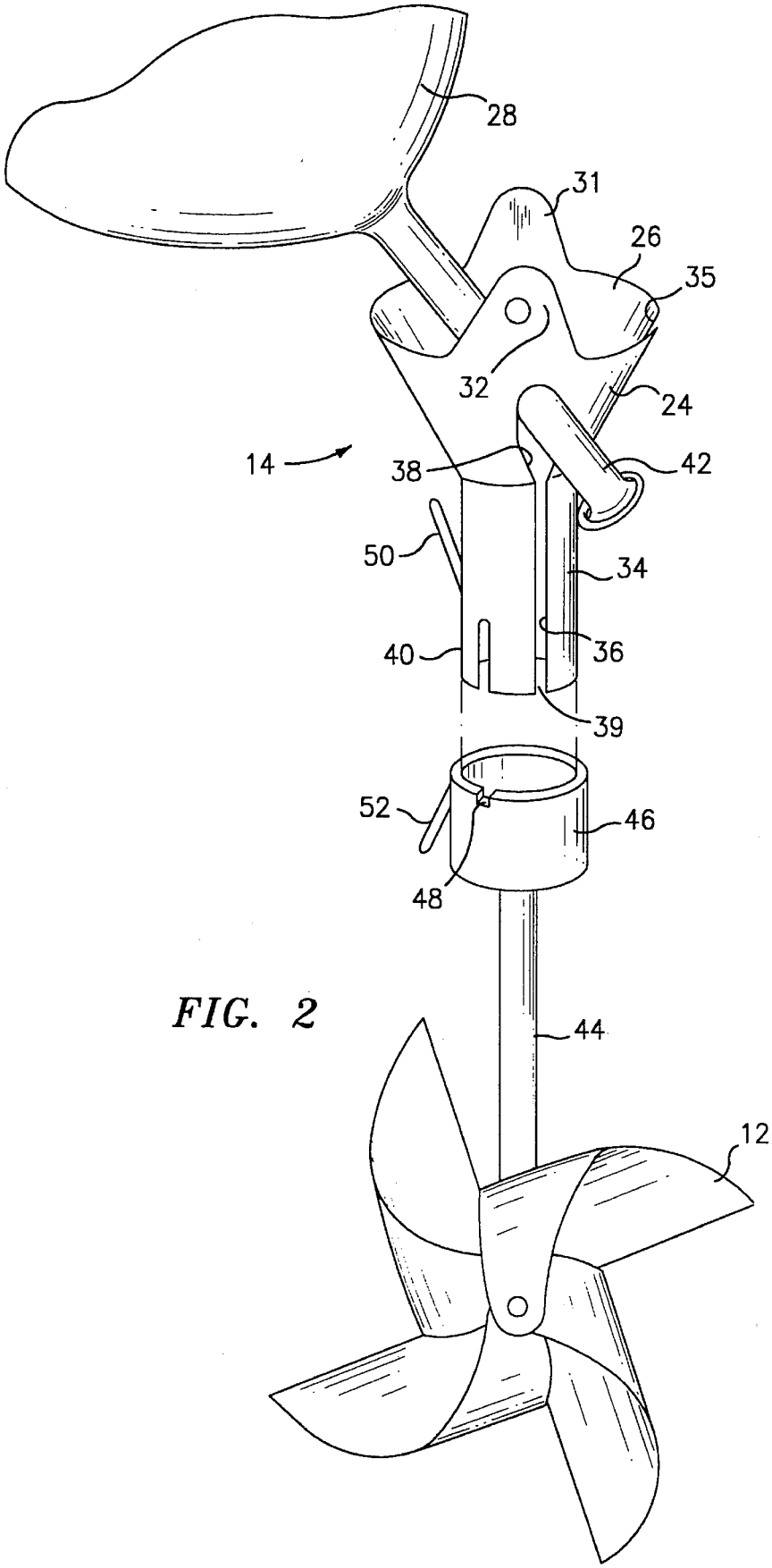
FIG. 2 illustrates in exploded form the adaptor of the present invention.

FIG. 2 illustrates in more detail the adaptor 14 of the present invention, and it is understood that the present invention can be practiced with a balloon of either the spherical type, or the popular Mylar-type which has an oblong cross section. As illustrated in FIG. 2, the aerial toy of the present invention is designed for use with the Mylar-type balloon of oblong cross section, and the adaptor 14 has an upper portion 24 with a flared opening 26 dimensioned to receive the lower portion 28 of a balloon having an oblong cross section. The flared opening 26, therefore, has an elliptical contour to receive the lower portion 28 of the balloon, and forward and rear portions of the flared opening 26 have upstanding supports 31 and 32 to snugly receive the forward and rearward portions, respectively of a Mylar-type balloon. These upstanding supports 31 and 32 further serve to support the balloon and forward and rearward portions of the attached pinwheel as a unitary structure when the toy is tilted forward as described above. Additionally, slots may be provided in the oblong ends of the flared opening 26, as shown at 35, to snugly receive the side seam of the balloon.

A cylindrical second portion 34 extends from the first portion 24, and has a longitudinal slot 36 extending from a side opening 38 in the first portion to an open end 39 in the lower portion of the cylindrical second portion. Additionally, a slot 40 extends upward partially along the cylindrical second portion from the open end 39.

Figure 3:
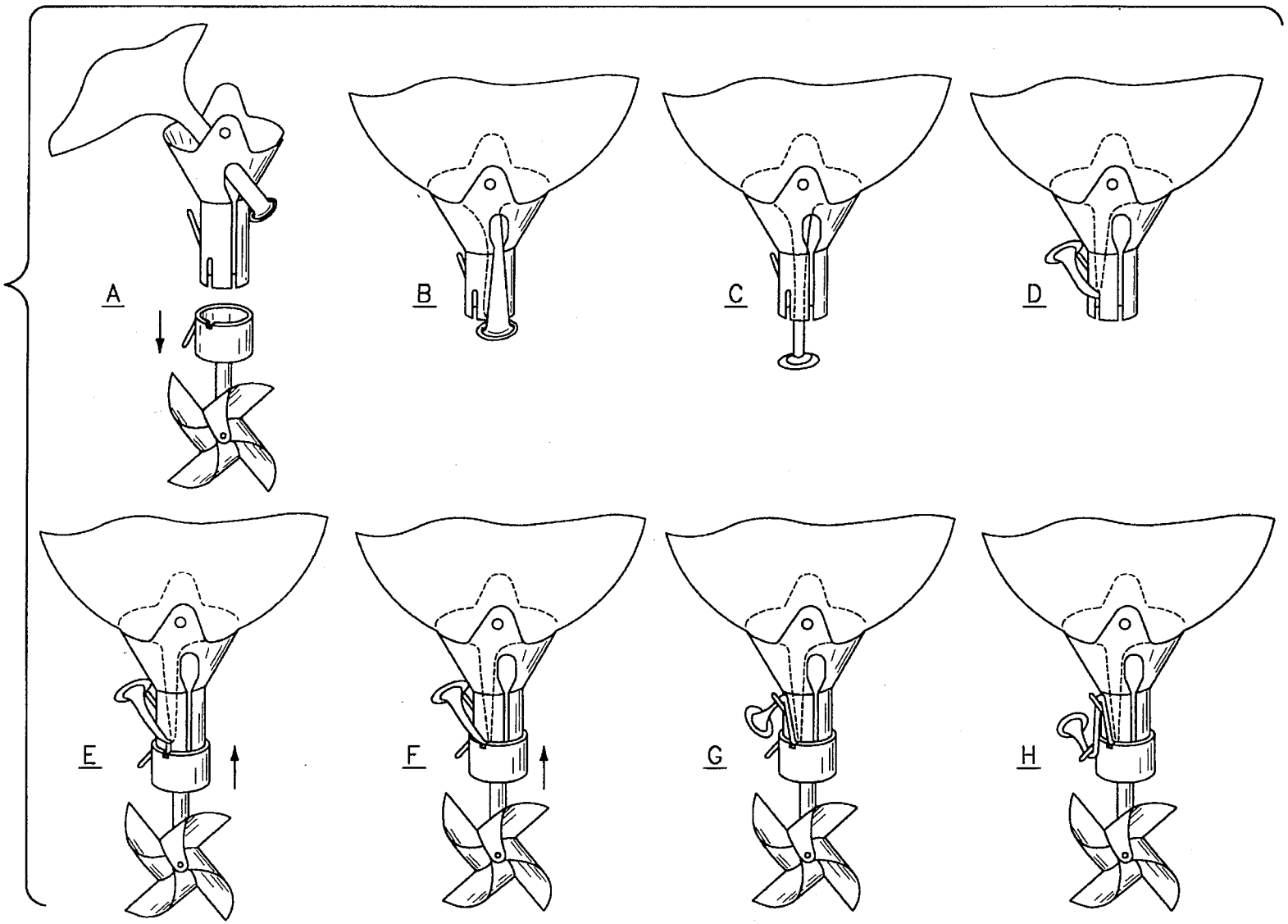
FIG. 3 illustrates the steps of connecting the balloon to the adaptor of the present invention.

In this way, the balloon can be fitted within the flared opening 26 with the stem 42 of the balloon extended through the opening 38. The balloon can then be centered within the flared opening 26, and the stem can be stretched and fitted through the slot 36 into the interior of the cylindrical second portion 34. The stem can then be brought upwardly and fitted within slot 40 which is dimensioned to pinch the stem 42 and prevent gas from escaping, as shown in parts A through D of the FIG. 3.

The adaptor additionally includes a lower portion 44 having a hollow cap member 46 with a recessed portion 48 in its inner sidewall, and this recessed portion fits along the slot 40 and serves to press the stem 42 of the balloon tightly against the sidewall of the cylindrical second portion 34. The cap member is fitted tightly over the open end 39 of the cylindrical second portion 34 and, in this way, serves to further seal the stem member 42 to prevent egress of gas. Additionally, the cap member 46 serves to strengthen the sidewalls of the second cylindrical portion 34.

The snug fit of the cap member 46 over the lower portion of the cylindrical second portion 34 serves to hold the pinwheel to the balloon, but to further secure the pinwheel and balloon together, the adaptor includes a projection 50 extending upwardly from the outside wall portion of the cylindrical second portion 34, and a projection 52 extends downwardly from an outer surface of the cap member 46. As illustrated in parts E through H of FIG. 3, the stem of the balloon can be stretched and wrapped around the projections 50 and 52 and then wedged in between one of the projections and the associated sidewall to assuredly fix the two portions 34 and 44 of the adapter together.

The aerial toy of the present invention and the particular adapter have been described with reference to preferred embodiments, but it is understood that the scope of the present invention is not limited by the descriptions above, but by the appended claims.

I claim:

1. An adaptor and pinwheel for use in releasably attaching to a balloon to form an aerial toy, said adaptor and pinwheel including:

a flared upper portion for engaging and retaining said balloon;

a cylindrical center portion with first and second ends and being attached to said upper portion at said first end, said center portion including a first closed end slot for receiving a stem from said balloon and a second closed end slot for engaging and sealing the end of said stem to prevent the escape of gas from said balloon; and a removable lower portion adapted to engage and attach to the cylindrical center portion at said second end to lock the stem of said balloon within said second closed slot, said lower portion including said pinwheel.

2. The adaptor of claim 1, wherein said upper portion is elliptically shaped.

3. The adaptor of claim 1, wherein said upper portion includes a pair of opposed upstanding supports to receive and support said balloon.

4. The adaptor of claim 1, wherein said lower portion is a cap.

5. The adaptor of claim 1, wherein said lower portion includes a recessed portion adapted to engage the second closed slot in said center portion to lock the stem of said balloon within said second closed slot.

6. An aerial toy including:

a balloon having a stem extending therefrom;

a pinwheel; and an adaptor for use in releasably attaching said pinwheel to said balloon, said adaptor including:

a flared upper portion for engaging and retaining said balloon;

a cylindrical center portion with first and second ends and being attached to said upper portion at first end, said center portion including a first closed end slot for receiving said stem from said balloon and a second closed end slot for engaging and sealing the end of said stem to prevent the escape of gas from said balloon; and a removable lower portion adapted to engage and attach to the cylindrical center portion at said second end to lock the stem of said balloon within said second closed slot, said lower portion including said pinwheel.

7. The toy of claim 6, wherein said balloon has a synthetic film outer surface.

8. The toy of claim 6, wherein said balloon includes means for securing a kite string thereto for tilting said aerial toy forwardly when said aerial toy is aloft so that said toy is capable of rising upwardly when the kite string is let out and upon tugging of said kit string, the toy will tilt forwardly.

9. The adaptor of claim 6, wherein said upper portion is elliptically shaped.

10. The adaptor of claim 6, wherein said upper portion includes a pair of opposed upstanding supports to receive and support said balloon.

11. The adaptor of claim 6, wherein said lower portion is a cap.

12. The adaptor of claim 6, wherein said lower portion includes a recessed portion adapted to engage the second closed slot in said center portion to lock the stem of said balloon within said second closed slot.

* * * * *